US012702162B2

(12) United States Patent
Miller et al.

(10) Patent No.: US 12,702,162 B2
(45) **Date of Patent: *Aug. 11, 2026**

(54) NICOTINE ELECTRONIC VAPING DEVICE INCLUDING A RESERVOIR ASSEMBLY

(71) Applicant: Altria Client Services LLC, Richmond, VA (US)

(72) Inventors: John H. Miller, Richmond, VA (US); Christopher S. Tucker, Midlothian, VA (US)

(73) Assignee: Altria Client Services LLC, Richmond, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/363,240

(22) Filed: Aug. 1, 2023

(65) Prior Publication Data

US 2023/0371593 A1 Nov. 23, 2023

Related U.S. Application Data

(63) Continuation of application No. 16/929,710, filed on Jul. 15, 2020, now Pat. No. 11,730,196.

(51) Int. Cl.
*A24F 40/42* (2020.01)
*A24F 40/10* (2020.01)
(Continued)

(52) U.S. Cl.
CPC ..... *A24F 40/42* (2020.01); *A24F 40/44* (2020.01); *A24F 40/485* (2020.01); *A24F 40/10* (2020.01)

(58) Field of Classification Search
CPC ..... A24F 40/42; A24F 40/44; A24F 40/485; A24F 40/10
See application file for complete search history.

(56) References Cited

U.S. PATENT DOCUMENTS 3,879,493 A * 4/1975 Mudde ..... C08L 51/00 521/905
8,528,569 B1 9/2013 Newton
(Continued)

FOREIGN PATENT DOCUMENTS

CN 103945716 A 7/2014
CN 105142443 A 12/2015
(Continued)

OTHER PUBLICATIONS

Partial International Search Report dated Jan. 7, 2022 for corresponding International Application No. PCT/EP2021/069850.
(Continued)

*Primary Examiner* — Phuong K Dinh
(74) *Attorney, Agent, or Firm* — Harness, Dickey & Pierce, P.L.C.

(57) ABSTRACT

A reservoir assembly for a nicotine e-vaping device includes an outer shell, a wick, and a membrane. The outer shell includes a first opening, an inner surface of the outer shell at least partially defining a reservoir configured to hold a nicotine pre-vapor formulation. The wick extends from an interior of the reservoir to an exterior of the reservoir. The wick is configured to draw the nicotine pre-vapor formulation held in the reservoir to the exterior of the reservoir. The first membrane covers the first opening. The first membrane is one or more layers of a fabric that is liquid impermeable and air permeable.

10 Claims, 8 Drawing Sheets

(51) Int. Cl.
*A24F 40/44* (2020.01)
*A24F 40/485* (2020.01)

(56) References Cited

U.S. PATENT DOCUMENTS

| | | | | |
|---|---|---|---|---|
| 8,646,461 | B2 | 2/2014 | von Borstel et al. | |
| 9,247,773 | B2 | 2/2016 | Memari et al. | |
| 9,956,357 | B2 | 5/2018 | Chen | |
| 9,974,334 | B2 | 5/2018 | Dooly et al. | |
| 11,730,196 | B2 * | 8/2023 | Miller | A24F 40/485 131/329 |
| 2013/0192621 | A1 * | 8/2013 | Li | H05B 1/0244 131/329 |
| 2013/0228191 | A1 | 9/2013 | Newton | |
| 2014/0283855 | A1 | 9/2014 | Hawes et al. | |
| 2014/0321837 | A1 * | 10/2014 | Flick | A61M 15/06 392/394 |
| 2017/0099878 | A1 | 4/2017 | Murison et al. | |
| 2017/0281883 | A1 | 10/2017 | Li et al. | |
| 2017/0360095 | A1 | 12/2017 | Batista | |
| 2018/0016040 | A1 | 1/2018 | Ewing et al. | |
| 2018/0035717 | A1 | 2/2018 | Batista | |
| 2018/0220707 | A1 * | 8/2018 | Biel | A24F 40/40 |
| 2018/0257797 | A1 | 9/2018 | Beer | |
| 2018/0310616 | A1 * | 11/2018 | Clemens | A24F 40/44 |
| 2019/0166913 | A1 * | 6/2019 | Trzecieski | A61M 15/06 |
| 2020/0037670 | A1 | 2/2020 | Fenner, Jr. et al. | |
| 2020/0138117 | A1 | 5/2020 | Rosser et al. | |
| 2020/0288787 | A1 * | 9/2020 | Hejazi | A24F 40/44 |
| 2022/0015420 | A1 | 1/2022 | Miller et al. | |
| 2022/0015421 | A1 | 1/2022 | Miller et al. | |

FOREIGN PATENT DOCUMENTS

| | | | |
|---|---|---|---|
| CN | 107635419 | A | 1/2018 |
| CN | 108135272 | A | 6/2018 |
| CN | 108348007 | A | 7/2018 |
| CN | 108669657 | A | 10/2018 |
| CN | 109922678 | A | 6/2019 |
| CN | 111107758 | A | 5/2020 |
| EP | 3127441 | A1 | 2/2017 |
| EP | 3622838 | A2 | 3/2020 |
| JP | 2018-528765 | A | 10/2018 |
| JP | 2018-532392 | A | 11/2018 |
| JP | 2019-083811 | A | 6/2019 |
| JP | 2019-531739 | A | 11/2019 |
| JP | 2020-517285 | A | 6/2020 |
| KR | 200454110 | Y1 | 6/2011 |
| KR | 10-2016-0119777 | A | 10/2016 |
| RU | 2639972 | C2 | 12/2017 |
| WO | WO-2015/117704 | A1 | 8/2015 |
| WO | WO-2017/137512 | A1 | 8/2017 |
| WO | WO-2018/071680 | A1 | 4/2018 |
| WO | WO-2019/154811 | A1 | 8/2019 |
| WO | WO-2019/193310 | A1 | 10/2019 |
| WO | 2019/224531 | A1 | 11/2019 |
| WO | WO-2019/219911 | A1 | 11/2019 |

OTHER PUBLICATIONS

International Search Report and Written Opinion thereof dated Jul. 1, 2022 for corresponding International Application No. PCT/EP2021/069580.
International Search Report and Written Opinion thereof dated Dec. 21, 2021 for corresponding International Application No. PCT/US2021/037793.
International Preliminary Report on Patentability dated Jan. 26, 2023 issued in related international patent application No. PCT/US2021/037793.
Office Action dated Mar. 8, 2023 issued in related U.S. Appl. No. 16/929,386.
Office Action dated Mar. 26, 2024 issued in U.S. Appl. No. 16/929,386.
Office Action dated Aug. 16, 2024 issued in U.S. Appl. No. 16/929,386.
Notice of Allowance dated Dec. 3, 2024 issued in Russian Patent Application No. 2023103222.
Office Action dated Sep. 27, 2024 issued in Russian Patent Application No. 2023103222.
Office Action dated Dec. 14, 2024 issued in Korean Patent Application No. 10-2023-7005166.
Office Action dated Mar. 13, 2025 issued in U.S. Appl. No. 16/929,386.
Extended Search Report dated Feb. 21, 2025 issued in European patent application No. 24203276.1.
Office Action dated Apr. 30, 2025 issued in Japanese patent application No. 2023-502684.
Office Action dated Jul. 2, 2025 issued in U.S. Appl. No. 16/929,386.
Notice of Allowance dated Jul. 23, 2025 issued in Korean patent application No. 10-2023-7005166.
Notice of Allowance dated Nov. 4, 2025 issued in Japanese patent application No. 2023-501227.
Office Action dated Jul. 1, 2025 issued in Japanese patent application No. 2023-501227.
Communication dated Aug. 26, 2025 issued in European patent application No. 21739879.1.
Office Action dated Aug. 27, 2025 issued in Chinese patent application No. 202180061508.0.
Decision to Grant dated Oct. 7, 2025 issued in Japanese patent application No. 2023-502684.
Office Action dated Feb. 12, 2026 issued in U.S. Appl. No. 16/929,386.
Office Action dated Mar. 20, 2026 issued in European patent application No. 24203276.1.
Office Action dated Jan. 22, 2026 issued in Chinese patent application No. 202180048346.7.
Office Action dated Feb. 27, 2026 issued in Chinese patent application No. 2021800615080.
Extended European Search Report dated Jun. 9, 2026 issued in European patent application No. 25223803.5.
Office Action dated Jun. 11, 2026 issued in U.S. Appl. No. 16/929,386.

* cited by examiner

NICOTINE ELECTRONIC VAPING DEVICE INCLUDING A RESERVOIR ASSEMBLY

CROSS-REFERENCE TO RELATED APPLICATIONS

This application is a continuation of U.S. application Ser. No. 16/929,710, filed on Jul. 15, 2020, the entire contents of which are hereby incorporated by reference in their entirety.

BACKGROUND

Field

Example embodiments generally relate to a nicotine electronic vaping (e-vaping) device including a reservoir assembly.

Description of Related Art

A nicotine e-vaping device includes a heating element that vaporizes a nicotine pre-vapor formulation held in a reservoir to produce a nicotine vapor.

SUMMARY

At least one example embodiment relates to a reservoir assembly for a nicotine e-vaping device. The reservoir assembly comprises an outer shell, a wick, and a membrane. The outer shell includes a first opening and an inner surface of the outer shell that at least partially defines a reservoir configured to hold a nicotine pre-vapor formulation including nicotine. The wick extends from an interior of the reservoir to an exterior of the reservoir, the wick configured to draw the nicotine pre-vapor formulation held in the reservoir to the exterior of the reservoir. The first membrane covers the first opening. The first membrane includes one or more layers of a fabric that is liquid impermeable and air permeable.

Other example embodiments relate to a reservoir assembly for a nicotine e-vaping device. The reservoir assembly includes an outer shell, a plunger, and a wick. The outer shell extends in a first direction. The outer shell includes a first end and an inner surface. The inner surface of the outer shell at least partially defines an interior of the outer shell. The plunger extends through the interior of the outer shell in a second direction normal to the first direction. The plunger includes a first surface and a second surface opposite the first surface. The first surface and a limited portion of the inner surface of the outer shell define a liquid containment area in a limited portion of the interior of the outer shell between the first surface of the plunger and the first end of the outer shell. The liquid containment area is a reservoir configured to hold the nicotine pre-vapor formulation. The plunger is configured to move in the first direction within the interior of the outer shell based on a first force applied on the first surface of the plunger by a volume of nicotine pre-vapor formulation contained in the liquid containment area. The wick extends from the interior of the outer shell to an exterior of the liquid containment area.

Other example embodiments relate to a method including providing an outer shell and a plunger, filling the liquid containment area with the nicotine pre-vapor formulation, and placing a portion of a wick into the liquid containment area. The outer shell extends in a first direction. The outer shell includes a first end, an opening in the first end, and an inner surface. The inner surface of the outer shell partially defines an interior of the outer shell. The plunger extends through the interior of the outer shell in a second direction normal to the first direction. The plunger includes a first surface and a second surface opposite the first surface. The first surface and a limited portion of the inner surface of the outer shell define a liquid containment area in the limited portion of the interior of the outer shell between the first surface of the plunger and the first end of the outer shell. The liquid containment area is a reservoir configured to hold the nicotine pre-vapor formulation. Filling the liquid containment area with the nicotine pre-vapor formulation is done such that the plunger is moved in the first direction away from the first end of the outer shell by the nicotine pre-vapor formulation, based on the nicotine pre-vapor formulation applying a first force on the first surface of the plunger.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

DETAILED DESCRIPTION

Figure 1:
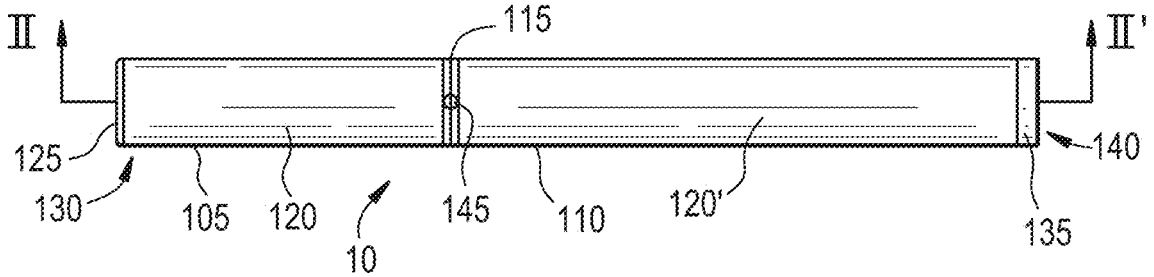
FIG. 1 is a side view of a nicotine electronic vaping (e-vaping) device according to at least one example embodiment.

Some detailed example embodiments are disclosed herein. However, specific structural and functional details disclosed herein are merely representative for purposes of describing example embodiments. Example embodiments may, however, be embodied in many alternate forms and should not be construed as limited to only the example embodiments set forth herein.

Accordingly, while example embodiments are capable of various modifications and alternative forms, example embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives falling within the scope of example embodiments. Like numbers refer to like elements throughout the description of the figures.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations or sub-combinations of one or more of the associated listed items.

It should be understood that, although the terms first, second, third, etc. may be used herein to describe various elements, regions, layers and/or sections, these elements, regions, layers, and/or sections should not be limited by these terms. These terms are only used to distinguish one element, region, layer, or section from another region, layer, or section. Thus, a first element, region, layer, or section discussed below could be termed a second element, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various example embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, and/or elements, but do not preclude the presence or addition of one or more other features, integers, steps, operations, elements, and/or groups thereof.

When the terms "about" or "substantially" are used in this specification in connection with a numerical value, it is intended that the associated numerical value includes a manufacturing or operational tolerance (e.g., ±10%) around the stated numerical value. Moreover, when the words "generally" or "substantially" are used in connection with geometric shapes, it is intended that precision of the geometric shape is not required but that latitude for the shape is within the scope of the disclosure. Further, regardless of whether numerical values or shapes are modified as "about" or "substantially," it will be understood that these values and shapes should be construed as including a manufacturing or operational tolerance (e.g., ±10%) around the stated numerical values or shapes.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

Hardware may be implemented using processing or control circuitry such as, but not limited to, one or more processors, one or more Central Processing Units (CPUs), one or more microcontrollers, one or more arithmetic logic units (ALUs), one or more digital signal processors (DSPs), one or more microcomputers, one or more field programmable gate arrays (FPGAs), one or more System-on-Chips (SoCs), one or more programmable logic units (PLUs), one or more microprocessors, one or more Application Specific Integrated Circuits (ASICs), or any other device or devices capable of responding to and executing instructions in a defined manner.

FIG. 1 is a side view of a nicotine electronic vaping (e-vaping) device 10 according to at least one example embodiment. The nicotine e-vaping device 10 can be considered an e-vaping nicotine delivery system (ENDS) device. In at least one example embodiment, the nicotine e-vaping device 10 includes a replaceable cartridge (or first section) 105 and a reusable battery section (or second section) 110. The first section 105 and the second section 110 may be coupled together at a connector assembly 115 with an air inlet 145.

In the example embodiment shown in FIG. 1, the first section 105 includes a first housing 120 and the second section 110 includes a second housing 120'. The nicotine e-vaping device 10 includes a mouth-end insert 125 at a first end 130, and an end cap 135 at a second end 140.

According to at least one example embodiment, the first housing 120 and the second housing 120' may have a generally cylindrical cross-section. In other example embodiments, the first and second housings 120 and 120' may have a generally triangular, rectangular, oval, square, or polygonal cross-section along one or more of the first section 105 and the second section 110. Furthermore, the first and second housings 120 and 120' may have the same or different cross-section shape, or the same or different size. As discussed herein, the first and second housings 120, 120' may also be referred to as outer or main housings.

Although example embodiments may be described in some instances with regard to the first section 105 coupled to the second section 110, example embodiments should not be limited to these examples.

Figure 2:
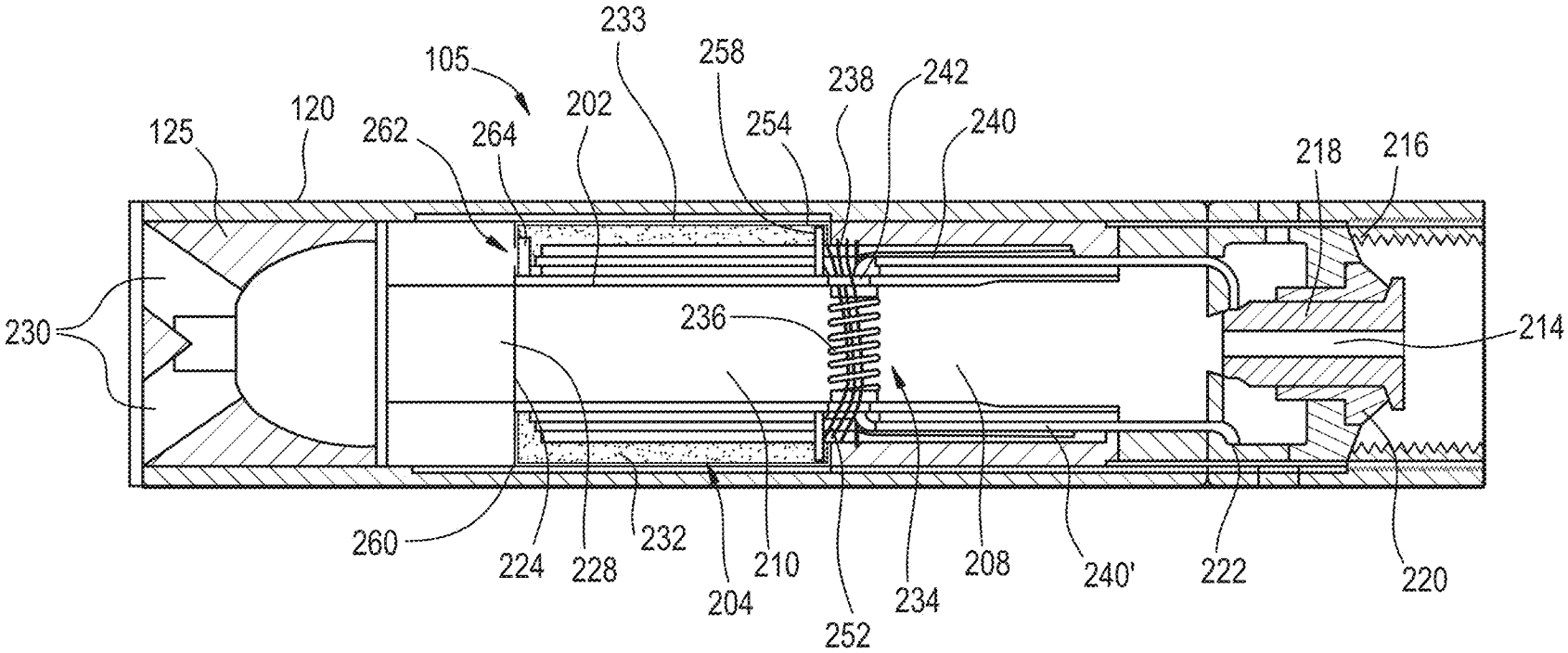
FIG. 2 is a cross-sectional view of an example embodiment of the first section of the nicotine e-vaping device shown in FIG. 1 along line II-II'.
Figure 3:
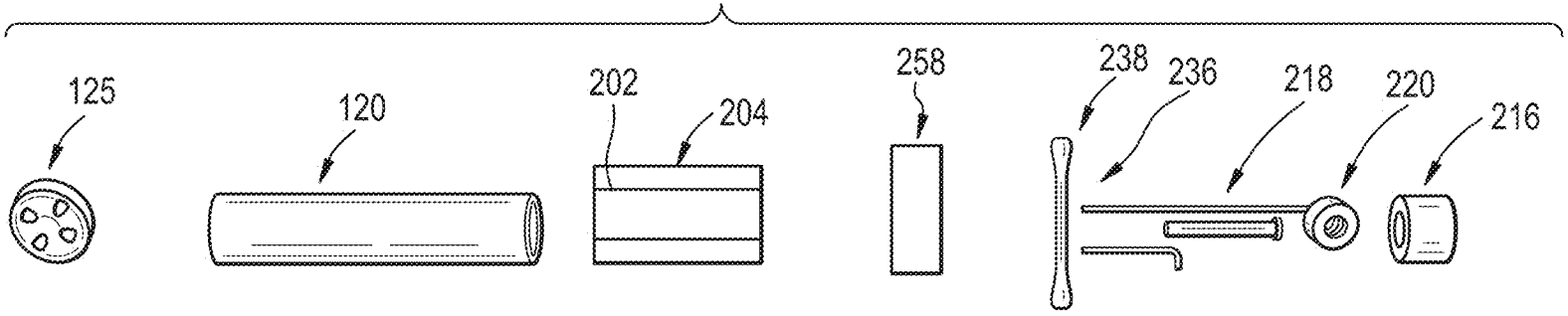
FIG. 3 is an exploded view of an example embodiment of the first section shown in FIG. 2.

FIG. 2 is a cross-sectional view of the first section 105 of the nicotine e-vaping device 10 along line II-II in FIG. 1. FIG. 3 is an exploded view of an example embodiment of the first section 105 shown in FIG. 2.

Referring to FIGS. 2 and 3, the first housing 120 extends in a longitudinal direction. A central, longitudinal air passage 208 extends through a portion of the first housing 120 and is in fluid communication with an air tube 202 of a reservoir assembly 204 to define an inner passage (also referred to as a central channel, or central inner passage) 210.

A first connector piece 216 is fitted into a first end of the first housing 120. The first connector piece 216 is part of the connector assembly 115 (shown in FIG. 1).

In at least one example embodiment, the first connector piece 216 is a hollow cylinder with female threads on a portion of the inner lateral surface. The first connector piece 216 is conductive, and may be formed of, or coated with, a conductive material. The female threads (or female threaded section) may be mated with male threads (or a male threaded section) of the second section 110 to connect the first section 105 and the second section 110. However, example embodiments are not limited to this example embodiment. Rather, the connectors may be, for example, snug-fit connectors, detent connectors, clamp connectors, clasp connectors, or the like. Moreover, the positioning of the male and female connectors may be reversed as desired such that the male connector is part of the first section 105.

A conductive post 218 nests within the hollow portion of the first connector piece 216. The conductive post 218 may be formed of a conductive material (e.g., stainless steel, copper, or the like) and may serve as an anode portion of the first connector piece 216.

The conductive post 218 defines the central air passage 214. A gasket insulator 220 holds the conductive post 218 within the first connector piece 216. The gasket insulator 220 also electrically insulates the conductive post 218 from an outer portion 222 of the first connector piece 216.

The outer portion 222 of the first connector piece 216 serves as the cathode connector of the first connector piece 216. The outer portion 222 may sometimes be referred to herein as a cathode connector or cathode portion. The outer portion 222 may be formed of a conductive material (e.g., stainless steel, copper, or the like).

Still referring to the example embodiment shown in FIGS. 2 and 3, a connection point 224 connects a central passage 228 (or channel) disposed between the inner passage 210 of the air tube 202 and the interior of the mouth-end insert 125. Nicotine vapor may flow from the inner passage 210 into a cavity within the mouth-end insert 125 through the central passage 228. In at least one example embodiment, the air tube 202 may have a diameter of about 4 mm.

The mouth-end insert 125 includes at least two outlets 230, which may be located off-axis from the longitudinal axis of the nicotine e-vaping device 10. The outlets 230 may be recessed or non-recessed and angled outwardly in relation to the longitudinal axis of the nicotine e-vaping device 10. The outlets 230 may be substantially uniformly distributed about the perimeter of the mouth-end insert 125 so as to substantially uniformly distribute nicotine vapor.

The first section 105 further includes the reservoir assembly 204. The reservoir assembly 204 includes a reservoir 232 including a reservoir housing 233 configured to store a nicotine pre-vapor formulation. The first section 105 also includes a vaporizer 234. The vaporizer 234 includes a heating element 236 and a wick 238. In some example embodiments, the vaporizer 234 is included in the reservoir assembly 204. The vaporizer 234 is configured to vaporize the nicotine pre-vapor formulation drawn from the reservoir 232 to form a nicotine vapor. A nicotine vapor, a nicotine aerosol, and a nicotine dispersion are used interchangeably and refer to the matter generated or output by any nicotine e-vaping devices and/or elements of the devices disclosed, claimed, and/or equivalents thereof, that contain nicotine.

As shown in FIG. 2, in at least one example embodiment, the reservoir 232 surrounds the inner passage 210 and the air tube 202. The heating element 236 may extend transversely across the inner passage 210 between opposing portions of the reservoir 232. In at least some example embodiments, the heating element 236 may extend parallel to a longitudinal axis of the inner passage 210.

The reservoir 232 may be sized and configured to hold enough nicotine pre-vapor formulation such that the nicotine e-vaping device 10 may be configured for vaping for at least about 200 seconds. Moreover, the nicotine e-vaping device 10 may be configured to allow each puff to last a maximum of about 5 seconds.

As mentioned above, the vaporizer 234 incudes the heating element 236 and the wick 238. The wick 238 may include at least a first end portion and a second end portion, which may extend into opposite sides of the reservoir 232. The heating element 236 may at least partially surround a central portion of the wick 238.

The wick 238 may draw the nicotine pre-vapor formulation from the reservoir 232 (e.g., via capillary action), and the heating element 236 may heat the nicotine pre-vapor formulation in the central portion of the wick 238 to a temperature sufficient to vaporize the nicotine pre-vapor formulation thereby generating a nicotine vapor.

In at least one example embodiment, the nicotine pre-vapor formulation is a material or combination of materials that may be transformed into a nicotine vapor. For example, the nicotine pre-vapor formulation may be a liquid, solid, and/or gel formulation including, but not limited to, water, beads, solvents, active ingredients, ethanol, plant extracts, natural or artificial flavors, and/or nicotine vapor formers, such as glycerin and propylene glycol. In some example embodiments, the nicotine pre-vapor formulation may include tobacco and/or other plant material, which may or may not be mixed with flavorants, nicotine vapor formers, fillers, binders, and/or polymers. The tobacco and/or other plant material may be in the form of leaves, shreds, films, bits, particles, powders, beads, and combinations of these.

In at least one example embodiment, the wick 238 may include filaments (or threads) having a capacity to draw the nicotine pre-vapor formulation. For example, the wick 238 may be a bundle of glass (or ceramic) filaments, a bundle including a group of windings of glass filaments, or the like, all of which arrangements may be capable of drawing nicotine pre-vapor formulation via capillary action by interstitial spacing between the filaments. The filaments may be generally aligned in a direction perpendicular (transverse) to the longitudinal direction of the nicotine e-vaping device 10. In at least one example embodiment, the wick 238 may include one to eight filament strands, each strand comprising a plurality of glass filaments twisted together. The end portions of the wick 238 may be flexible and foldable into the confines of the reservoir 232. The filaments may have a cross-section that is generally cross-shaped, clover-shaped, Y-shaped, or in any other suitable shape.

In at least one example embodiment, the wick 238 may include any suitable material or combination of materials. Examples of suitable materials may be, but are not limited to, glass and ceramic- or graphite-based materials. The wick 238 may have any suitable capillarity drawing action to accommodate nicotine pre-vapor formulations having different physical properties such as density, viscosity, surface tension, and vapor pressure. The wick 238 may be non-conductive.

In at least one example embodiment, the heating element 236 (or heater) may include a coil of wire (a heater coil) which at least partially surrounds the wick 238. The wire used to form the coil of wire may be metal. The heating element 236 may extend fully or partially along the length of the wick 238. The heating element 236 may further extend fully or partially around the circumference of the wick 238. In some example embodiments, the heating element 236 may or may not be in contact (or direct contact) with the wick 238. The heating element 236 may be part of a vapor assembly. The vapor assembly may include the heating element 236, and the air passages, and any other portions of the nicotine e-vaping device which assist in the forming of a nicotine vapor from the nicotine pre-vapor formulation.

In the example embodiment shown in FIGS. 2 and 3, the heating element 236 is electrically connected to the conductive post 218 via a first electrical lead 240, and to the outer portion 222 via a second electrical lead 240'. Accordingly, the outer portion 222 and the conductive post 218 form respective external electrical connection to the heating element 236.

In at least some other example embodiments, the heating element 236 may be in the form of a planar body, a ceramic body, a single wire, a mesh, a cage of resistive wire, or any other suitable form. More generally, the heating element 236 may be any heater that is configured to vaporize a nicotine pre-vapor formulation.

In at least one example embodiment, the heating element 236 may be formed of any suitable electrically resistive materials. Examples of suitable electrically resistive materials may include, but are not limited to, copper, titanium, zirconium, tantalum, and metals from the platinum group. Examples of suitable metal alloys include, but are not limited to, stainless steel, nickel, cobalt, chromium, aluminum-titanium-zirconium, hafnium, niobium, molybdenum, tantalum, tungsten, tin, gallium, manganese and iron-containing alloys, and super-alloys based on nickel, iron, cobalt, stainless steel.

For example, the heating element 236 may be formed of nickel aluminide, a material with a layer of alumina on the surface, iron aluminide, and other composite materials, the electrically resistive material may optionally be embedded in, encapsulated or coated with an insulating material or vice-versa, depending on the kinetics of energy transfer and the external physicochemical properties required. The heating element 236 may include at least one material selected from the group consisting of stainless steel, copper, copper alloys, nickel-chromium alloys, super alloys, and combinations thereof. In an example embodiment, the heating element 236 may be formed of nickel-chromium alloys or iron-chromium alloys. In another example embodiment, the heating element 236 may be a ceramic heater having an electrically resistive layer on an outside surface thereof.

In at least one example embodiment, the heating element 236 may heat nicotine pre-vapor formulation in the wick 238 by thermal conduction. Alternatively, heat from the heating element 236 may be conducted to the nicotine pre-vapor formulation by means of a heat conductive element or the heating element 236 may transfer heat to the incoming ambient air that is drawn through the nicotine e-vaping device 10 during vaping, which in turn heats the nicotine pre-vapor formulation by convection.

In at least one example embodiment, as shown in FIG. 2, the reservoir assembly 204 is shown where the wick 238 passes over the air tube 202 and adjacent a first opening 252 at a first end 254 of an outer shell 256 of the reservoir assembly 204. A transfer material 258 may be adjacent to the wick 238. The reservoir 232 for the nicotine pre-vapor formulation may be defined by an inner surface of the outer shell 256 between the first end 254 of the outer shell 256 and a second end 260 of the outer shell 256. The transfer material 258 and wick 238 may be configured to work together to wick the nicotine pre-vapor formulation to an exterior of the reservoir 232.

In some example embodiments, the first opening 252 extends through a side of the air tube 202 (not shown). If the outer shell 256 is cylindrical in shape, the reservoir 232 may be annular spaced between an outer surface of the air tube 202 and an inner surface of the outer shell 256 and between the first end 254 and the second end 260 of the outer shell 256. The reservoir 232 may contain the nicotine pre-vapor formulation. Example embodiments are shown with the outer shell 256 having a cylindrical shape, however, the outer shell 256 may have a shape other than a cylinder, such as rectangular, square, oval, or any other shape.

In at least one example embodiment, as shown in FIG. 2, the reservoir assembly 204 may include a second opening 262 defined in the second end 260 of the outer shell 256. The second opening 262 may be covered by a membrane 264. The membrane 264 may be one or more layers of fabric. The fabric may be air permeable but water impermeable. For example the fabric may be Gore-Tex or a fabric made of woven hydrophobic fibers or a fabric with a hydrophobic coating.

During transportation, especially transportation by airplane, any air which is in the reservoir 232 may expand due to the decrease in air pressure outside of the reservoir. The expanding air may escape the reservoir 232 through the membrane 264. Thus, there may not be a differential in pressure between the interior of the reservoir and an exterior of the reservoir. Providing a mechanism by which the air in the reservoir can be removed from the reservoir reduces the potential for leakage of the nicotine pre-vapor formulation from the reservoir 232 during transportation, shipping, and use.

Figure 5:
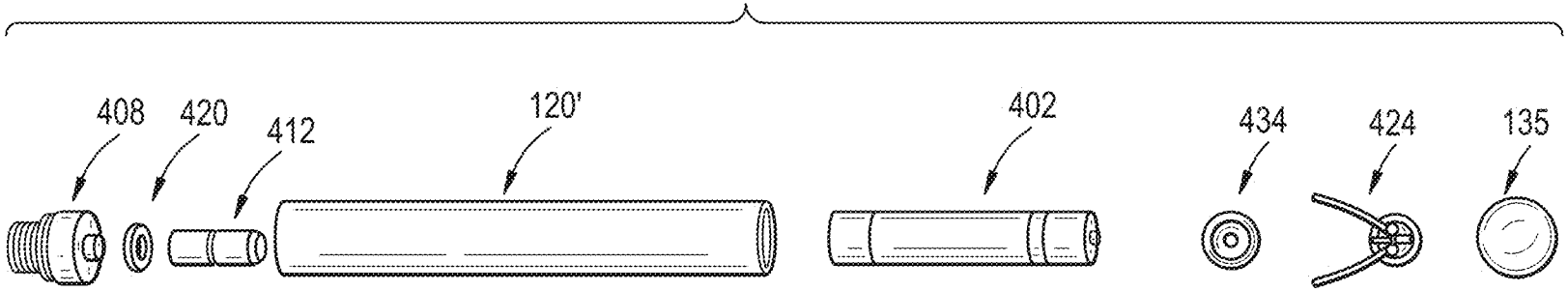
FIG. 5 is an exploded view of an example embodiment of the second section shown in FIG. 4.
Figure 4:
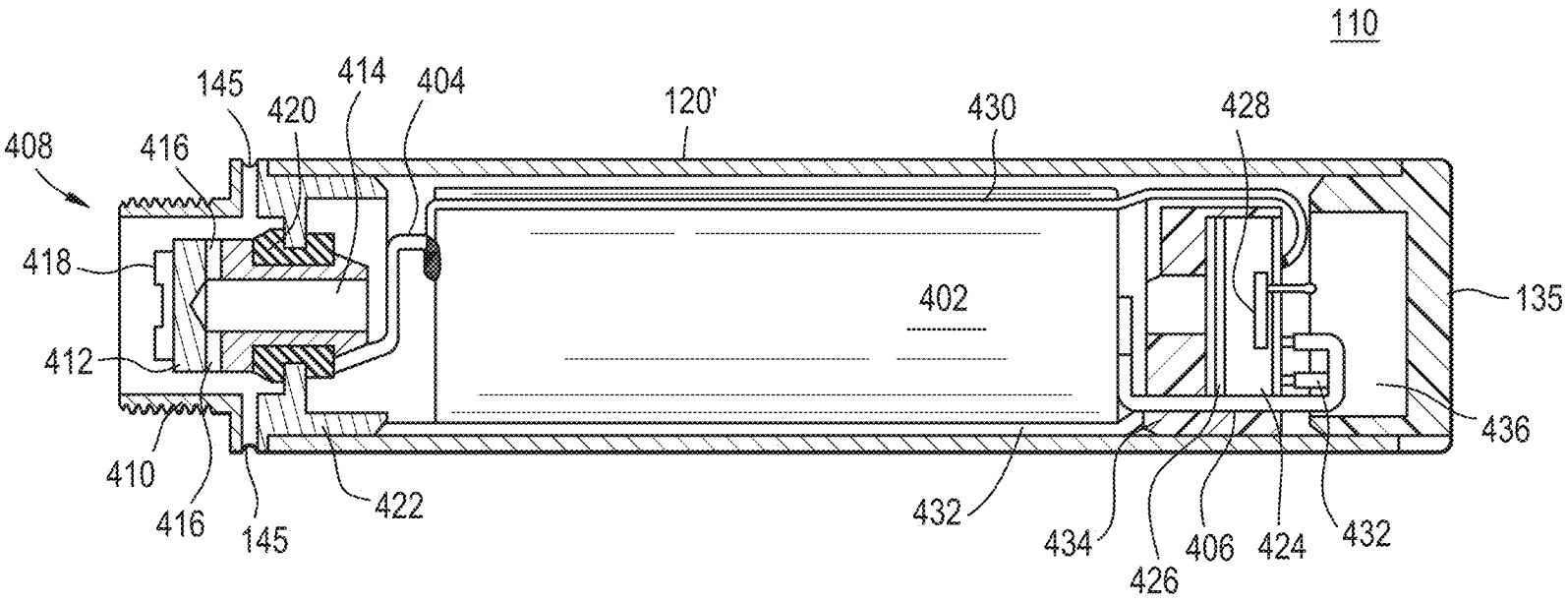
FIG. 4 is a cross-sectional view of an example embodiment of a second section of the nicotine e-vaping device shown in FIG. 1 along line II-II'.

FIG. 4 is a cross-sectional view of a second section of an example embodiment of the nicotine e-vaping device 10 along line II-II' of FIG. 1. FIG. 5 is an exploded view of an example embodiment of the second section 110 shown in FIG. 4.

The second section 110 may be a reusable section of the nicotine e-vaping device 10, wherein the reusable section may be capable of being recharged by an external charging device. Alternatively, the second section 110 may be disposable. In this example, the second section 110 may be used until the energy from a power supply 402 (described below) is depleted (e.g., the energy fails below a threshold level).

Referring to FIGS. 4 and 5, according to at least this example embodiment, the power supply 402 includes an anode connection 404 and a cathode connection 406. Each of the anode connection 404 and the cathode connection 406 may be in the form of one or more electrical leads or wires. The power supply 402 (or power source) may be a battery. For example, the power supply 402 may be a Lithium-ion battery, or a variant of a Lithium-ion battery, such as a Lithium-ion polymer battery. The battery may either be disposable or rechargeable. The power supply may be configured to supply electrical power to the heating element 236.

The second section 110 further includes a connector piece 408 at a first end of the second section 110. In the example embodiment shown in FIG. 4, the connector piece 408 is a male connector configured to connect to the female first connector piece 216 of the first section 105. Alternatively, the connector piece 408 may be a female connector configured to connect to a male connector of the first section 105.

In the example embodiment shown in FIG. 4, the connector piece 408 includes threads 410 configured to mate with corresponding threads on the first connector piece 216 of the first section 105. Although illustrated as a threaded connection, according to at least some other example embodiments, the connector piece 408 may be, for example, snug-fit connectors, detent connectors, clamp connectors, clasp connectors, or the like.

The cathode connection (connector piece 408) of the power supply 402 terminates at, and is electrically connected to, a sensor assembly 424 positioned proximate to a second end of the second section 110. The sensor assembly 424 will be discussed in more detail later.

The anode connection 404 terminates at, and is electrically connected to, a conductive post 412. The conductive post 412 may serve as the anode portion of the connector piece 408. The conductive post 412 defines a central passage 414, which is in fluid communication with one or more side vents 416. The side vents 416 may be holes bored into the conductive post 412. The central passage 414 and the one or more side vents 416 allow for puff detection by the sensor assembly (e.g., a puff sensor assembly) 424 resulting from changes in pressure when air is drawn in through air inlets 145.

Although only 2 side vents 416 and two air inlets 145 are shown in FIG. 4, example embodiments should not be limited to this example. Rather, the conductive post 412 may include any number of side vents 416, and the connector piece 408 may include any number of air inlets 145. For example, the conductive post 412 may include 4 side vents 416 spaced apart at equal distances around the conductive post 412. Similarly, the connector piece 408 may include 4 air inlets 145 spaced apart at equal distances around the connector piece 408.

The conductive post 412 further includes an upper portion 418 having an indentation allowing air drawn through the air inlets 145 to flow and/or communicate through the end of the second section 110 into the first section 105 when connected to the second section 110.

The conductive post 412 may be formed of a conductive material (e.g., stainless steel, copper, or the like), and nested within the hollow portion of the connector piece 408. When the connector piece 408 of the second section 110 is coupled to the first connector piece 216 of the first section 105, the upper portion 418 (and the conductive post 412) physically and electrically connects to the conductive post 218 to allow flow of electrical current from the power supply 402 to the heating element 236. The electrical connection also allows for electrical signaling between the first section 105 and the second section 110.

Still referring to FIGS. 4 and 5, a gasket insulator 420 holds the conductive post 412 within the connector piece 408. The gasket insulator 420 also electrically insulates the conductive post 412 from an outer portion 422 of the connector piece 408. The outer portion 422 may be formed of a conductive material (e.g., stainless steel, copper, or the like) and may serve as a cathode portion of the connector piece 408.

As mentioned above, the connector piece 408 includes one or more air inlets 145 configured to communicate ambient air into the connector piece 408. The air inlets 145 may also be sometimes referred to as vents or air vents.

The ambient air drawn into the connector piece 408 may combine and/or mix with air flowing out of the one or more side vents 416 and flow into the first section 105, when the first section 105 is coupled to the second section 110. In at least one example embodiment, the air inlets 145 may be bored into the connector piece 408 just below the threads 410 at an angle perpendicular or substantially perpendicular to the longitudinal centerline of the connector piece 408.

The sidewalls of the air inlets 145 may be beveled in order to cause the sidewalls to slope inwards (e.g., to "countersink" the sidewalls at the rim of the air inlets 145). By beveling the sidewalls at the rim of the air inlets 145 (as opposed to using relatively sharp edges at the rim of the air inlets 145), the air inlets 145 may be less likely to become clogged or partially blocked (due to a reduction in the effective cross-sectional area of the air inlets 145 near the rim of the air inlets 145). In at least one example embodiment, the sidewalls of the rim of the air inlets 145 may be beveled (inclined) to be about 38 degrees relative to a longitudinal length (or the longitudinal centerline) of the connector piece 408 and the second housing 120' of the second section 110.

In at least one example embodiment, the air inlets 145 may be sized and configured such that the nicotine e-vaping device 10 has a resistance-to-draw (RTD) in the range of from about 60 mm $H_2O$ to about 150 mm $H_2O$.

Referring still to FIGS. 4 and 5, as mentioned above, the second section 110 includes a sensor assembly (e.g., a puff sensor assembly) 424.

As shown in FIG. 4, for example, the sensor assembly 424 is electrically connected and powered by the power supply 402. In at least this example embodiment, the sensor assembly 424 includes a sensor (e.g., a puff sensor) 426 and control circuitry 428.

The control circuitry 428 is configured to provide an electrical current and/or electrical signaling to the first section 105. To this end, the control circuitry 428 is electrically connected to the conductive post 412 (anode portion of the connector piece 408) via control circuitry wiring (or lead) 430, and to the outer (cathode) portion 422 of the connector piece 408 via control circuitry wiring (or lead) 432. In at least this example, the control circuitry wiring 432 acts as a cathode for the electrical circuit including the sensor assembly 424.

The sensor 426 may be a capacitive sensor capable of sensing an internal pressure drop within the second section 110. The sensor 426 and the control circuitry 428 may function together to open and close a heater control circuit (not shown) between the power supply 402 and the heating element 236 of the first section 105 when coupled to the second section 110. In at least one example embodiment, the sensor 426 is configured to generate an output indicative of a magnitude and direction of airflow through the nicotine e-vaping device 10. In this example, the control circuitry 428 receives the output of the sensor 426, and determines if (1) the direction of the airflow indicates an application of negative pressure to (e.g., draw on) the mouth-end insert 125 (versus positive pressure or blowing) and (2) the magnitude of the application of negative pressure exceeds a threshold level. If these vaping conditions are met, then the control circuitry 428 electrically connects the power supply 402 to the heating element 236 to activate the heating element 236.

In one example, the heater control circuit may include a heater power control transistor (not shown). The control circuitry 428 may electrically connect the power supply 402 to the heating element 236 by activating the heater power control transistor. In at least one example, the heater power control transistor (or heater control circuit) may form part of the control circuitry 428.

The control circuitry 428 and the sensor 426 may be separate components arranged on a printed circuit board and connected via electrical contacts. Additionally, although discussed herein with regard to a capacitive sensor, the sensor 426 may be any suitable pressure sensor, for example, a Microelectromechanical system (MEMS) including a piezo-resistive or other pressure sensor.

The control circuitry 428 may include, among other things, a controller. According to one or more example embodiments, the controller may be implemented using hardware, a combination of hardware and software, or storage media storing software. Hardware may be implemented using processing or control circuitry such as, but not limited to, one or more processors, one or more Central Processing Units (CPUs), one or more microcontrollers, one or more arithmetic logic units (ALUs), one or more digital signal processors (DSPs), one or more microcomputers, one or more field programmable gate arrays (FPGAs), one or more System-on-Chips (SoCs), one or more programmable logic units (PLUs), one or more microprocessors, one or more Application Specific Integrated Circuits (ASICs), or any other device or devices capable of responding to and executing instructions in a defined manner.

In another example embodiment, the control circuitry 428 may include a manually operable switch for manually activating the heating element 236.

In at least one example embodiment, the control circuitry 428 may include a time-period limiter to limit the time period during which electrical current is continuously supplied to the heating element 236. The time period may be set or pre-set depending on the amount of nicotine pre-vapor formulation desired to be vaporized. In one example, the time period for continuous application of electrical current to the heating element 236 may be limited such that the heating element 236 heats a portion of the wick 238 for less than about 10 seconds. In another example, the time period for continuous application of electrical current to the heating element 236 may be limited such that the heating element 236 heats a portion of the wick 238 for about 5 seconds.

Still referring to FIGS. 4 and 5, the sensor assembly 424 is cradled within a sensor holder 434 at the second end of the second section 110. In at least one example embodiment, the sensor holder 434 may be part of a silicon or rubber gasket. However, example embodiments should not be limited to this example.

A heat activation light 436 may also be arranged to the second end of the second section 110. In the example embodiment shown in FIG. 4, the heat activation light 436 may be arranged within the end cap 135. The heat activation light 436 may include one or more light-emitting diodes (LEDs). The LEDs may include one or more colors (e.g., white, yellow, red, green, blue, or the like). Moreover, the heat activation light 436 may be configured to glow when the power supply 402 supplies electrical current to the heating element 236. The heat activation light 436 may be utilized for nicotine e-vaping system diagnostics or to indicate that recharging of the power supply 402 is in progress. The heat activation light 436 may also be configured such that the heat activation light 436 may be activated or deactivated for privacy. The heat activation light 436 may be part of, or electrically connected to, the sensor assembly 424.

Figure 6:
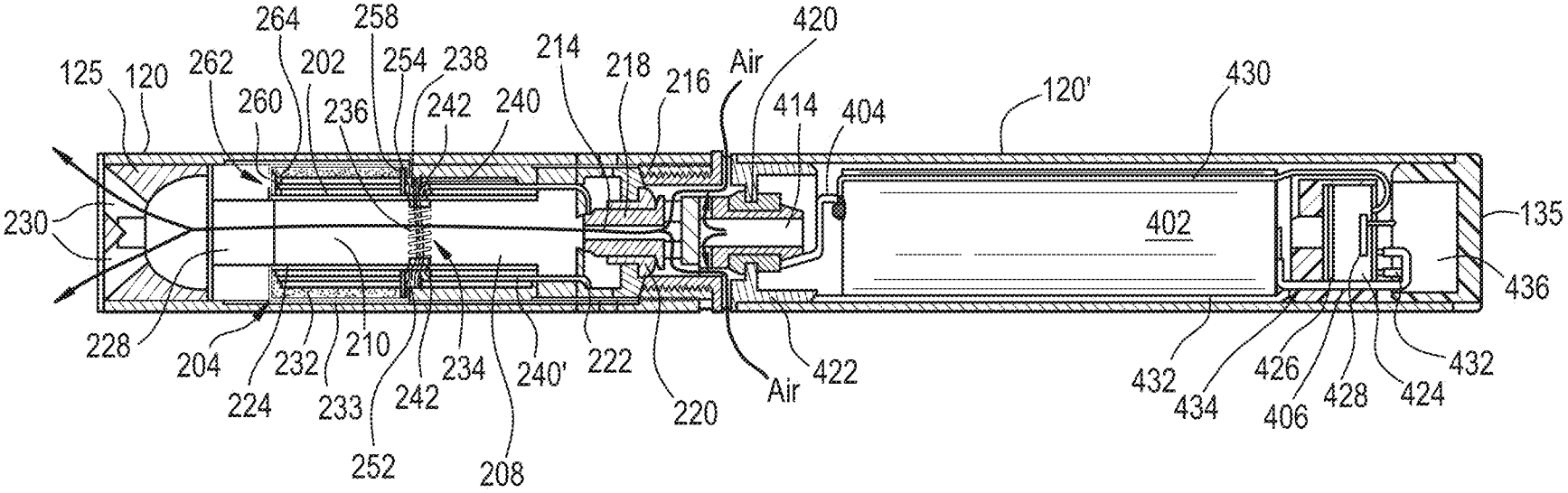
FIG. 6 is a cross-sectional view of an example embodiment of the nicotine e-vaping device shown in FIG. 1 along line II-II'.

FIG. 6 is a cross-sectional view of an example embodiment of the nicotine e-vaping device shown in FIG. 1 along line II-II'.

In FIG. 6, the first section 105 is shown coupled to the second section 110. The arrows in FIG. 6 indicate example air flow through the nicotine e-vaping device 10.

Operation of the nicotine e-vaping device 10 to create a nicotine vapor when the first section 105 is coupled to the second section 110 will now be described with regard to FIG. 6.

Referring to FIG. 6, air is drawn primarily into the first section 105 through the at least one of the air inlets 145 in response to application of negative pressure to the mouth-end insert 125.

If the control circuitry 428 detects the vaping conditions discussed above, then the control circuitry 428 initiates supply of power to the heating element 236, such that the heating element 236 heats nicotine pre-vapor formulation on the wick 238 to generate nicotine vapor.

The air drawn through the air inlet 145 enters the cavity within the connector piece 408 and passes through the indentation in the upper portion 418 into the central air passage 214. From the central air passage 214, air flows through through the air passage 208, and then through the inner passage 210.

The air flowing through the inner passage 210 combines and/or mixes with the nicotine vapor generated by the heating element 236, and the air-nicotine vapor mixture passes from the inner passage 210 into the central passage 228 and then into the cavity within the mouth-end insert 125. From the cavity in the mouth-end insert 125, the air-nicotine vapor mixture flows out of the outlets 230.

Figure 7:
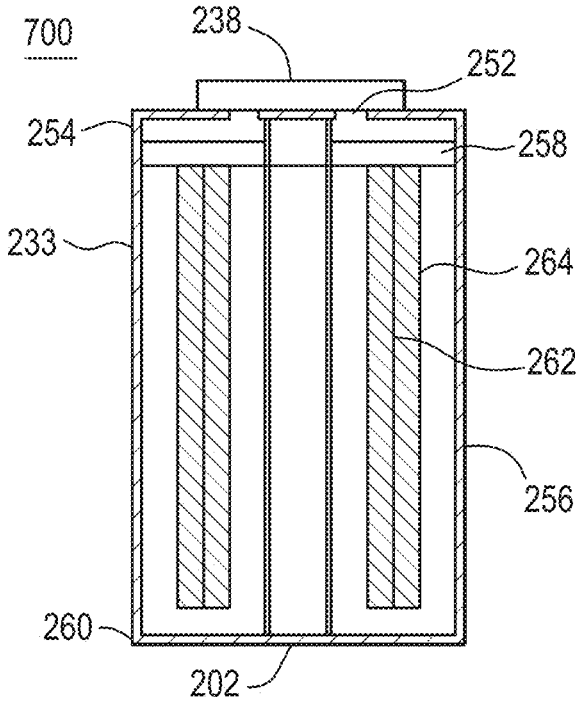
FIG. 7 is a cross-sectional view of an example embodiment of the reservoir assembly.

FIG. 7 is a cross-sectional view of an example embodiment of a reservoir assembly 700.

In at least one example embodiment, the reservoir assembly 700 of FIG. 7 is the same as the reservoir assembly 204 of FIG. 2 except that the reservoir assembly 700 includes the second opening 262 in the form of a slit in the outer shell 256. The slit may extend from the first end 254 of the outer shell 256 to the second end 260 of the outer shell 256. Alternatively, the slit may extend for only a portion of the distance between the first end 254 and the second end 260 of the outer shell 256.

In at least one example embodiment, the reservoir assembly 200 may include multiple second openings 262 in the form of slits. Two of the second openings 262 may be slits on opposite sides of the outer shell 256. Having multiple slits allows for multiple places for air to escape the reservoir 232 so as to equalize the air pressure between the interior of the reservoir 232 and the exterior of the reservoir. For example, if only about one tenth of the reservoir 232 contains air, the reservoir 232 may be positioned such that the air does not contact the membrane 264 covering the second opening 262 such that air cannot escape if there is only one second opening 262. However, if there are multiple second openings 262 the air may escape through one of the other second openings 262. The second openings 262 may extend in any direction along the outer shell 256. The second openings 262 may be covered by one or more membranes 264. For example, each second opening 262 may be covered by a respective membrane 264.

Figure 8:
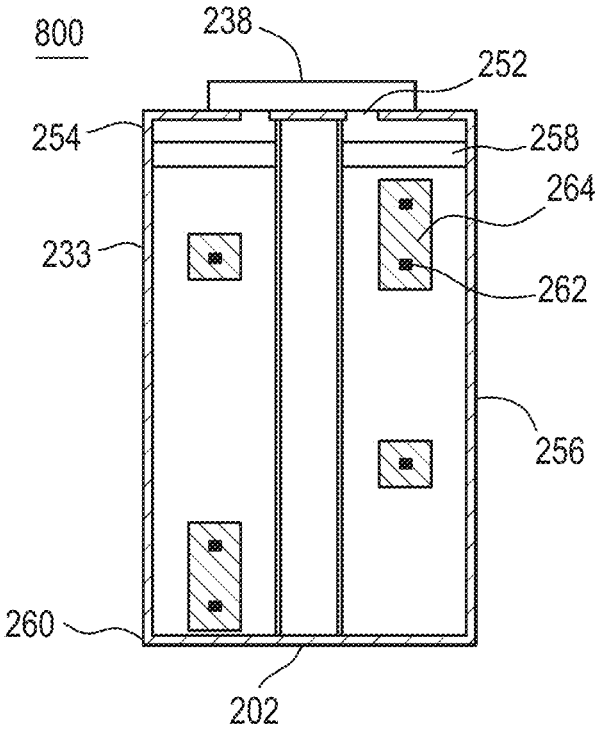
FIG. 8 is a cross-sectional view of another example embodiment of the reservoir assembly.

FIG. 8 is a cross-sectional view of another example embodiment of the reservoir assembly 800.

In at least one example embodiment, as shown in FIG. 8, the reservoir assembly 800 is the same as the reservoir assembly 204 of FIG. 2, except that the second opening 262 is in the form of a pinhole. In at least one example embodiment, the reservoir assembly 800 may include a plurality of second openings 262 in the form of pinholes. The multiple second openings 262 may be covered by one or more membranes 264. For example, each second opening 262 may be covered by a respective membrane 264.

Figure 9:
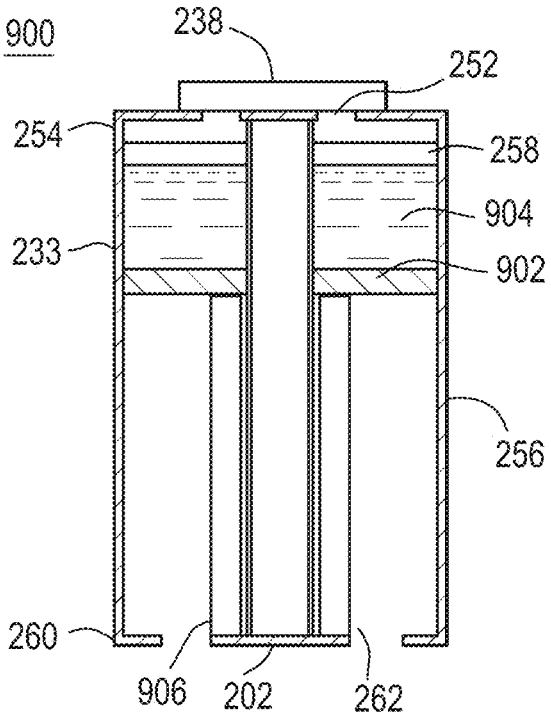
FIG. 9 is a cross-sectional view of another example embodiment of the reservoir assembly.

FIG. 9 is a cross-sectional view of another example embodiment of the reservoir assembly 900.

In at least one example embodiment, as shown in FIG. 9, the reservoir assembly 900 is the same as the reservoir assembly 204 of FIG. 2. except that the reservoir assembly 900 includes a plunger 902 which extends across the interior of the outer shell 256 forming a seal such that nicotine pre-vapor formulation cannot pass below the plunger 902. A first side of the plunger 902 and a portion of the outer shell 256 define a liquid containment area 904 (or reservoir) for the nicotine pre-vapor formulation. If the reservoir assembly 900 includes the air tube 202, the plunger 902 includes a hole such that the plunger 902 fits around the air tube 202 within the outer shell 256. The plunger 902 may be configured to move based on the volume of nicotine pre-vapor formulation in the liquid containment area 904. For example, as nicotine pre-vapor formulation is pulled by the wicking force through the wick 238 and the transfer material 258, the pressure of the fluid in the liquid containment area 904 is decreased while the atmospheric pressure of an exterior of the liquid containment area 904 remains the same. This change in pressures causes a force on the first side of the plunger 902 to decrease, while the atmospheric pressure on a second side of the plunger 902, opposite the first side of the plunger 902, remains the same. The difference in force causes the plunger 902 to move in a first direction toward the first end 254 of the outer shell 256.

If a friction force of the plunger 902 against the outer shell 256 and/or the air tube 202 is greater than the difference in force, the plunger 902 will not move. An optional passive actuator 906 may apply a third force to the second side of the plunger 902 in order to overcome the friction force. The passive actuator 906 may be a spring in an interior of the outer shell 256 pressing on the second end 260 of the outer shell 256 and the second side of the plunger 902.

In at least one example embodiment, the reservoir assembly 900 may include multiple second openings 262 in the form of slits. Two of the second openings 262 may be slits on opposite sides of the outer shell 256. Having multiple slits allows for multiple places for air to escape the reservoir 232 so as to equalize the air pressure between the interior of the reservoir 232 and the exterior of the reservoir.

Figure 10:
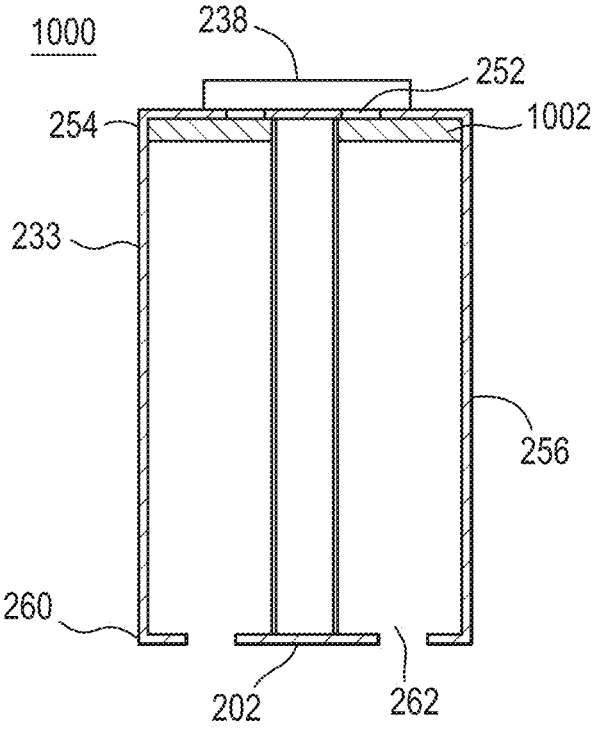
FIG. 10 is a cross-sectional view of another example embodiment of the reservoir assembly.

FIG. 10 is a cross-sectional view of an example embodiment of a reservoir assembly 1000 before filling the reservoir assembly 1000 with nicotine pre-vapor formulation.

In at least one example embodiment, the reservoir assembly 1000 may have the outer shell 256 with the first opening 252 (or openings) in the first end 254 of the outer shell 256. A plunger 1002 may be provided in an interior of the outer shell 256 with a first side of the plunger 1008 in contact with the first end 254 of the outer shell 256, the plunger 1008 extending across the interior of the outer shell 256. The first side of the plunger 1002 and a limited portion of the interior of the outer shell 256 defining a liquid containment area for nicotine pre-vapor formulation.

The liquid containment area in FIG. 10 has no volume. This is done so that there is no air in the liquid containment area before the reservoir assembly is filled with nicotine pre-vapor formulation. As previously stated, the plunger 1002 reduces and/or prevents air from being included in the nicotine pre-vapor formulation, so as to reduce and/or prevent leakage during transportation, shipping and/or vaping.

Figure 11:
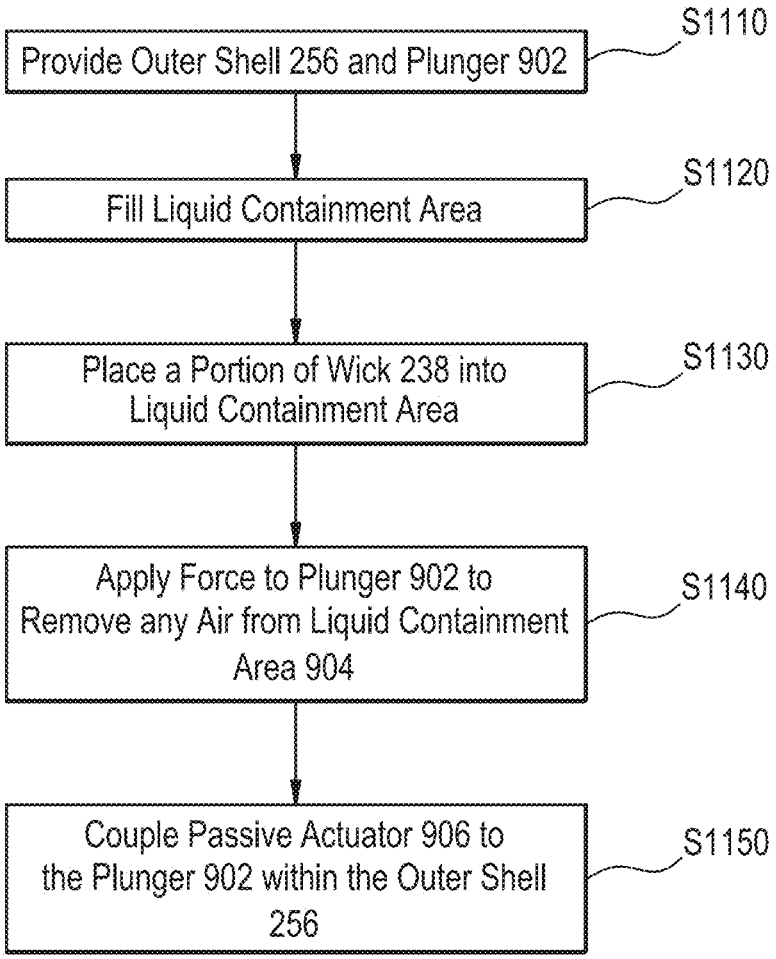
FIG. 11 is a flow diagram of a method of preparing a reservoir assembly.

FIG. 11 is a flow diagram of a method of preparing a reservoir assembly.

In at least one example embodiment, as shown in FIG. 11, at S1110, the reservoir assembly 900 is provided with the outer shell 256 and the plunger 902. For example, the reservoir assembly may be provided as shown in FIG. 9.

At S1120, the liquid containment area is filled with nicotine pre-vapor formulation. This may be accomplished by connecting the first opening 252 (or openings) to a filling device (not shown), the filling device may supply nicotine pre-vapor formulation to the first opening 252 and apply hydraulic pressure to the nicotine pre-vapor formulation to press the plunger 902 in a first direction away from the first end 254 of the outer shell 256. As the plunger 902 moves in the first direction, the liquid containment area increases in volume and is filled with nicotine pre-vapor formulation. A small amount of air, such as air which was in the first opening 252 before the filling device was connected to the first opening 252, may also enter into the liquid containment area 904. The plunger 902 may move until the second side of the plunger 902 contacts the second end 260 of the outer shell 256 or may move to any location between the first end 254 and the second end 260 of the outer shell 256 based on the volume of nicotine pre-vapor formulation supplied to the reservoir assembly 900.

At S1130, a portion of the wick 238 may be placed into the liquid containment area 904 through the first opening 252. The wick 238 may be a two stage wick or a single stage wick. When the wick 238 is inserted, the wick 238 may contain a small amount of air within the wick 238. The wick 238 will absorb some of the nicotine pre-vapor formulation and some or all of the air in the liquid containment area via a wicking action. The wicking action will generally cause a significant portion of the air contained in the liquid containment area and air within the wick 238 to escape through the wick 238 to an exterior of the liquid containment area.

S1140 is optional. At S1140, if desired, a force may be applied to the second side of the plunger 902 to remove any air from the liquid containment area 904. The force may be applied by hand or with a tool, machine, or some form or actuator, such as the passive actuator 906. The force may be applied for a set amount of time or until nicotine pre-vapor formulation begins to be forced out of the wick to an exterior of the liquid containment area 904. This operation may not be necessary if a negligible amount of air has entered into the liquid containment area.

S1150 is also optional. At S1150, the passive actuator 906 may be coupled to the second side of the plunger 902 within the outer shell 256. The passive actuator 906 may be coupled to the second end of the outer shell 256. The passive actuator 906 may be a spring or other form of passive actuator which is inserted through the second opening 262. The passive actuator 906 may be inserted after the liquid containment area 904 is filled with nicotine pre-vapor formulation.

A reservoir assembly 900, which is prepared according to the operations of FIG. 11, may have the advantage of having no air, or a negligible amount of air, within the liquid containment area 904 such that the liquid containment area does not include the plunger 902 or the passive actuator 906. Instead, the reservoir assembly may resemble FIGS. 1, 6, 7, and 8 and include opening(s) 262 covered by the membrane 264 to compensate for the removal of liquid from the reservoir.

Example Embodiments with Nicotine Pre-Vapor Formulation

The nicotine pre-vapor formulation includes nicotine. In an example embodiment, a flavoring (at least one flavorant) is included in the nicotine pre-vapor formulation. In an example embodiment, the nicotine pre-vapor formulation is a liquid, solid and/or gel formulation including, but not limited to, water, beads, solvents, active ingredients, ethanol, plant extracts, natural or artificial flavors, and/or at least one nicotine vapor former such as glycerin and propylene glycol.

In an example embodiment, the at least one nicotine vapor former of the nicotine pre-vapor formulation includes diols (such as propylene glycol and/or 1, 3-propanediol), glycerin and combinations, or sub-combinations, thereof. Various amounts of nicotine vapor former may be used. For example, in some example embodiments, the at least one nicotine vapor former is included in an amount ranging from about 20% by weight based on the weight of the nicotine pre-vapor formulation to about 90% by weight based on the weight of the nicotine pre-vapor formulation (for example, the nicotine vapor former is in the range of about 50% to about 80%, or about 55% to 75%, or about 60% to 70%), etc. As another example, in an example embodiment, the nicotine pre-vapor formulation includes a weight ratio of the diol to glycerin that ranges from about 1:4 to 4:1, where the diol is propylene glycol, or 1,3-propanediol, or combinations thereof. In an example embodiment, this ratio is about 3:2. Other amounts or ranges may be used.

In an example embodiment, the nicotine pre-vapor formulation includes water. Various amounts of water may be used. For example, in some example embodiments, water may be included in an amount ranging from about 5% by weight based on the weight of the nicotine pre-vapor formulation to about 40% by weight based on the weight of the nicotine pre-vapor formulation, or in an amount ranging from about 10% by weight based on the weight of the nicotine pre-vapor formulation to about 15% by weight based on the weight of the nicotine pre-vapor formulation. Other amounts or percentages may be used. For example, in an example embodiment, the remaining portion of the nicotine pre-vapor formulation that is not water (and not nicotine and/or flavorants), is the nicotine vapor former (described above), where the nicotine vapor former is between 30% by weight and 70% by weight propylene glycol, and the balance of the nicotine vapor former is glycerin. Other amounts or percentages may be used.

In an example embodiment, the nicotine pre-vapor formulation includes at least one flavorant in an amount ranging from about 0.2% to about 15% by weight (for instance, the flavorant may be in the range of about 1% to 12%, or about 2% to 10%, or about 5% to 8%). In an example embodiment, the at least one flavorant may be at least one of a natural flavorant, an artificial flavorant, or a combination of a natural flavorant and an artificial flavorant. For instance, the at least one flavorant may include menthol, etc.

In an example embodiment, the nicotine pre-vapor formulation includes nicotine in an amount ranging from about 1% by weight to about 10% by weight. For instance, nicotine is in the range of about 2% to 9%, or about 2% to 8%, or about 2% to 6%. In an example embodiment, the portion of the nicotine pre-vapor formulation that is not nicotine and/or the flavorant, includes 10-15% by weight water, where the remaining portion of the nicotine pre-vapor formulation is a mixture of propylene glycol and a nicotine vapor former, where the mixture is in a ratio that ranges between about 60:40 and 40:60 by weight. Other combinations, amounts or ranges may be used.

Example embodiments have been disclosed herein, it should be understood that other variations may be possible. Such variations are not to be regarded as a departure from the spirit and scope of the present disclosure, and all such modifications as would be obvious to one skilled in the art are intended to be included within the scope of the following claims.

We claim:

1. A reservoir assembly for a nicotine e-vaping device, the reservoir assembly comprising:

an outer shell extending in a first direction, the outer shell including a first end and an inner surface, the inner surface of the outer shell defining an interior of the outer shell; and a plunger extending through the interior of the outer shell in a second direction normal to the first direction, the plunger including a first surface and a second surface opposite the first surface, a portion of the inner surface of the outer shell defining a liquid containment area in a portion of the interior of the outer shell between the first surface of the plunger and the first end of the outer shell, the liquid containment area being a reservoir configured to hold nicotine pre-vapor formulation, the plunger configured to move in the first direction within the interior of the outer shell in response to a first force being applied to the first surface of the plunger by a volume of the nicotine pre-vapor formulation contained in the liquid containment area, the nicotine pre-vapor formulation including nicotine.

2. The reservoir assembly of claim 1, further comprising:

a wick extending from the interior of the outer shell to an exterior of the liquid containment area.

3. The reservoir assembly of claim 1, wherein the outer shell is cylindrical in shape, and the first direction extends along a longitudinal axis of the outer shell.

4. The reservoir assembly of claim 2, further comprising:

a conduit extending in the first direction through the interior of the outer shell, wherein the plunger includes an opening through which the conduit passes.

5. The reservoir assembly of claim 4, wherein the wick extends through the opening in the conduit.

6. The reservoir assembly of claim 2, wherein the wick extends through an opening in the first end of the outer shell.

7. The reservoir assembly of claim 2, further comprising:

a passive actuator configured to continuously apply a second force on the second surface of the plunger.

8. The reservoir assembly of claim 7, wherein a magnitude of the second force is less than a magnitude of the first force associated with forcing the nicotine pre-vapor formulation to pass through the wick from the liquid containment area to an exterior of the outer shell.

9. The reservoir assembly of claim 1, wherein the plunger is configured to move within the outer shell based only on the first force applied on the first surface of the plunger by the volume of the nicotine pre-vapor formulation contained in the liquid containment area and a third force applied on the second surface of the plunger by atmospheric pressure.

10. A cartridge, comprising:

the reservoir assembly of claim 1; and a vaporizer assembly including a heater and a wick, the vaporizer assembly configured to generate a nicotine vapor based on heating the nicotine pre-vapor formulation drawn from the interior of the liquid containment area by the wick.

* * * * *